US006283312B1

(12) United States Patent
Edgerton

(10) Patent No.: US 6,283,312 B1
(45) Date of Patent: Sep. 4, 2001

(54) T-NOTCH, BOX CLOSER, PACKAGE HANGER LINK, AND STRIP

(75) Inventor: John Edgerton, 15158 Herring Ave., San Jose, CA (US) 95124-3424

(73) Assignee: John Edgerton, San Jose, CA (US)

( * ) Notice: Subject to any disclaimer, the term of this patent is extended or adjusted under 35 U.S.C. 154(b) by 0 days.

(21) Appl. No.: 09/488,646

(22) Filed: Jan. 20, 2000

(51) Int. Cl.[7] ..... A47F 5/00

(52) U.S. Cl. ..... 211/113; 211/118; 211/85.29; 24/16 PB; 24/30.5

(58) Field of Search ..... 211/113, 118, 211/85.29; 24/16 PB, 30.5 S, 30.5 P; 248/317, 339, 300, 301

(56) References Cited

U.S. PATENT DOCUMENTS

| | | | | |
|---|---|---|---|---|
| 2,128,723 | * | 8/1938 | Zettler . | |
| 3,874,034 | * | 4/1975 | Clayton | 24/30.5 P |
| 3,997,943 | * | 12/1976 | Jones et al. | 24/30.5 P |
| 4,112,988 | * | 9/1978 | Nelson | 24/16 PB X |
| 4,176,423 | * | 12/1979 | Wigemark . | |
| 4,466,159 | * | 8/1984 | Burrage | 24/16 PB |
| 4,483,502 | * | 11/1984 | Fast . | |
| 4,942,644 | * | 7/1990 | Rowley | 24/16 PB |
| 5,743,403 | * | 4/1998 | Crysdale . | |
| 5,762,212 | * | 6/1998 | Pomerantz | 211/113 |
| 5,832,568 | * | 11/1998 | Higuchi | 24/30.5 R |

* cited by examiner

*Primary Examiner*—Robert W. Gisbon, Jr.

(57) ABSTRACT

A product hanging system comprised of one or more product hanging straps plus a point-of-purchase hanging strip said strip having one or more through cut slots of suffieient size to acccept a notched T shaped end of a strap portion of the invention with both the straps and the hanging strip being produced from sufficiently strong flexible natural or colored plastic. The strip being of equal width having a through cut hole top center used to suspend it from a hook or wire and spaced through cut slots down its length. Product to be hung is secured to a strap of the invention then the opposite end of the strap is attached to a hanging strip with the attachment method being a "T" shaped strap end is fed into a through cut slot, entry of the head of the "T" into said slot being accomplished by engaging a key notch on the body of the T. After full entry of the head of the T shaped end of the strap into the slot the notch is disengaged allowing the head of the T to seat in said slot, the notch showing below the slot is visible evidence of a strap to slot lock. This method of "T" into slot connection is used to secure a strap end to through cut slots found in; Link up product display strips, other straps, packaged products with through cut slots, displays and other items with a sufficiently cut slot. In order to hang coiled or folded electric cords a T shaped end of a strap is fed through a slot in the opposing end forming a loop in the strap a loop that closes when the end of the strap passing through the slot is lifted, in this way items to be hung can be cinched within the body of a strap and secured there with a slight bend of the strap body at the loop. The strap with cinched product is secured on a product display strip using the notch of the T as a key. Removal requires a lift of the strap so the notch in the strap end engages the slot in the strip, once the notch is engaged twist the strap to the side to remove the rounded head of the T shaped end of the strap from the slot in the strip. The strap portion of the invention can also be used to close carton flaps. A slit is cut in each carton flap to be closed then each end of the strap is inserted and locked in each of the slits. The strap acts like a bridge securing the box flaps and forming a light load handle in the process with removal of one strap end allowing access to the contents of the carton. Corner flaps of a carton can be kept open for product loading using the notched T into slit method of connection.

7 Claims, 5 Drawing Sheets

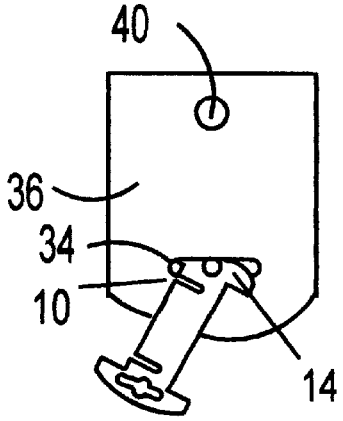
Fig. 10
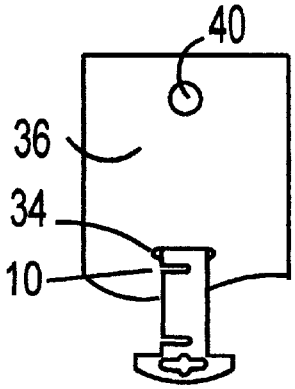
Fig. 11
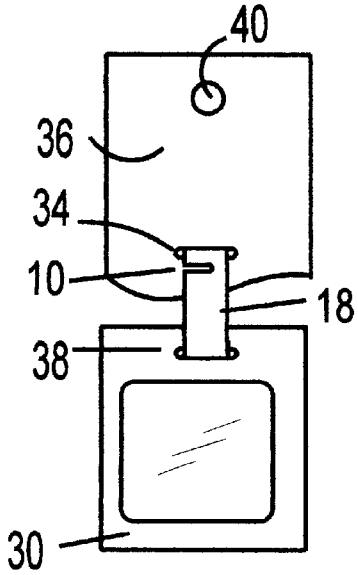
Fig. 12
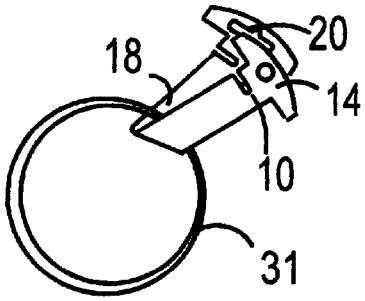
Fig. 14
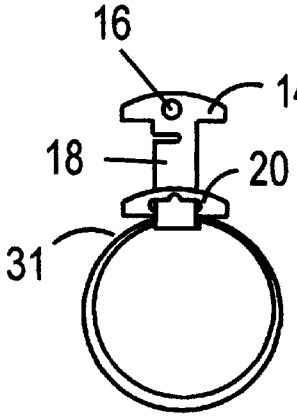
Fig. 15
Fig. 13
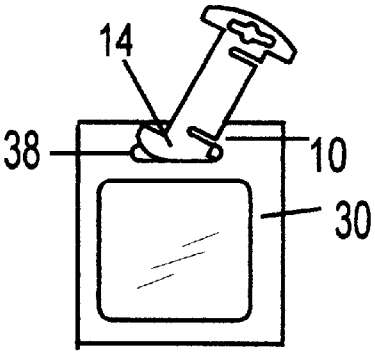
Fig. 16
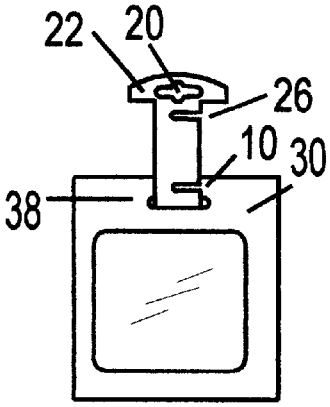
Fig. 17
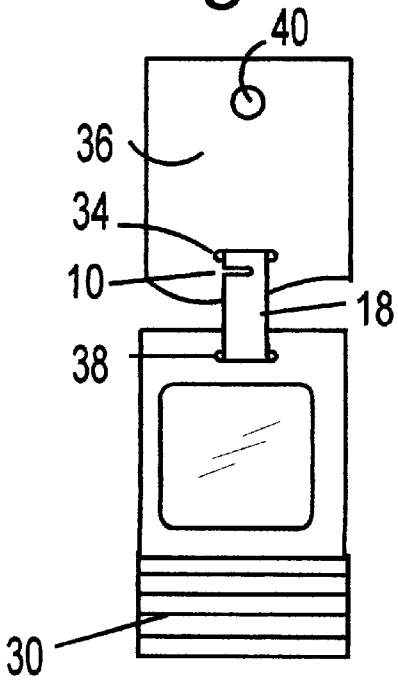

T-NOTCH, BOX CLOSER, PACKAGE HANGER LINK, AND STRIP

FIELD OF THE INVENTION

This invention relates to the practice of hanging blister packaged or skin packaged products by means of a plastic strip with integral cutouts to suspend these products. This invention being; a strap that is attached to a product and then said strap is attached to a point-of-purchase dispaly strip using one of the through cut slots in the strip as an attachment point for one of the strap ends.

BACKGROUND OF THE INVENTION

There are a variety of products being sold in stores that are sealed by means of a clear plastic generally called a Skin or a Blister. The difference between the two is found in the word describing the process. A blister is a clear plastic cover that has actually been heated and then formed using a special mold and a vacuum. The heated plastic takes the shape of the mold after the vacuum is applied. Once the formed blisters cool they can be used. Blisters are placed over the product and glued to the board the product has been placed on. Skin packaging is another way to seal product to a printed board. Multiple products are placed on a special skin packaging (porous) board then a plastic film with a special glue is used to seal the product to the board by using heat and a vacuum. The board with its products attached is placed on a cutting die that is used to cut out the familiar sealed product cards we see in stores.

Goods that have been sealed in plastic skins or bubbles are getting heavier and hanging strips that are being used today just do not have a visible lock or the strength needed to safely support some of them. Locks and batteries as well as other items being sealed to cards can fall off strips such as the CLIP STRIP FOR SUPPORTING MULTIPLE PACKAGES AND DISPLAY ASSEMBLY USING SAME U.S. Pat. No. 5,199,578 Pendergraph et al. This flexible plastic hanging strip has a number of tab shapes cut into it that face up these are to receive the holes that are cut into the board of the blister packaged product. Other products can fall from the strip as a single item is being taken or if the strip is turned or inverted products can fall then as well. Looking at another hanging strip called the ADJUSTABLE STRIP MERCHANDISER U.S. Pat. No. 5,386,916 Valiulis we see the hanging strip made of flexible plastic with interlocking fingers spaced at intervals down the strip to accept the hole in the packaged goods. This particular strip had perforations which looked good but were to weak to support the load of goods intended to hang on it. In addition the fingers of the strip do not work well with some of the cutouts in the blister packs meant to hang on them. One of the later attempts of hanging strip construction is the INVERTED T TAB MEMBER HANGING STRIP U.S. Pat. No. 5,743,403 Crysdale.

The Crysdale strip has T-Shaped cutout portions for holding blister packaged items. According to the abstract it is made from a transparent non stretchable material and it has an inverted T that engages the article. We need to note here that the material the strip is made from has to be light enough to allow the T to be jammed into the hole in the product package. Also some products such as electronic calculators, or batteries or locks are too heavy a load for this strip and product could fall from it. Also the stiff nature of the material the strip is made from can act like a knife to cut away at the cutout in the product package causing a rip or tear there.

It is important for store owners and department managers to know that when goods are accessed by the customer only what is needed is released from the hanging strip unfortunately that is not always the case with the previously discussed inventions.

SUMMARY OF THE PRESENT INVENTION

The purpose of this invention is to provide the manufacturers of packaged product a versatile, secure method to attach goods to a hanging display strip. Using this invention will help to prevent accidents caused by packages falling from a hanging strip. When products attached to a strap are acessed a "T" shaped end of the strap must be unlocked from the product hanging strip by disengaging a notch in the link used to connect the goods to the hanging strip.

The purpose of this invention is to provide a safe way to hang or display merchandise in stores. This invention not only provides a secure connection of goods to strip but allows easy accessibility by the customer as well.

The key to this invention is its ability to accommodate a number of different products that need to be displayed giving merchandisers a safe secure way to display their products. Straps can be attached to packaged goods using the T and locking notch found on either end of the strap.The straps can be cinched around a coiled, bundled or folded extension cord and then the strap with its product load can be hung on the hanging strip of the invention or on a pegboard hook. Craft or hobby stores will be able to secure product to a strap with staples or nails this will allow them to hang wooden items. Multiple products can be loaded on a strap and be removed one at a time or sold as a unit.

The present invention can be used to keep box flaps open for loading or closed until such time access to goods inside the box is required. One cuts a slit in each of the box flaps an end of the strap is secured in each of the slits. The strap when attached to slits in the top box flaps acts as a bridge forcing the flaps closed. Slits cut vertically in each of the open corner flaps of a carton are used to secure each end of a strap, the strap secures both connected flaps in an open position until it is removed. The origin of the T and locking notch design began with the box closer provisional patent application No. 60/108,022 Dated Nov. 12, 1998 John Robert Edgerton San Jose, Calif. *small entity*

BRIEF DESCRIPTION OF DRAWING FIGURES

The figures and drawings provided illustrate the preferred construction of the invention as well as clearly describe the uses and features of the invention.

Drawings:

FIG. 1 Is a front view of the link section of the invention.

FIG. 2 Is a front view of blister packaged item 30 attached to the body 18 of the link FIG. 3 Is a partial front view of the hang strip portion of the invention 36 showing the T of the link 14 and notch 10 attachment method into strip cut out 34.

FIG. 4 Is a partial front view of the hang strip portion of the invention 36 with link body 18 secured to product package 30 and the notch 10 in lock position.

FIG. 5 Is a partial front view of the hang strip portion of the invention 36 with linked products 30 ready to suspend from hole 40

FIG. 10 Is a partial front view of the hang strip portion of the invention 36 showing link attachment method.

FIG. 11 Is a partial front view of the hang strip portion of the invention 36 with link 18 secured in place.

Figures 1, 2, 3, 4, 5, 6, 7, 8:
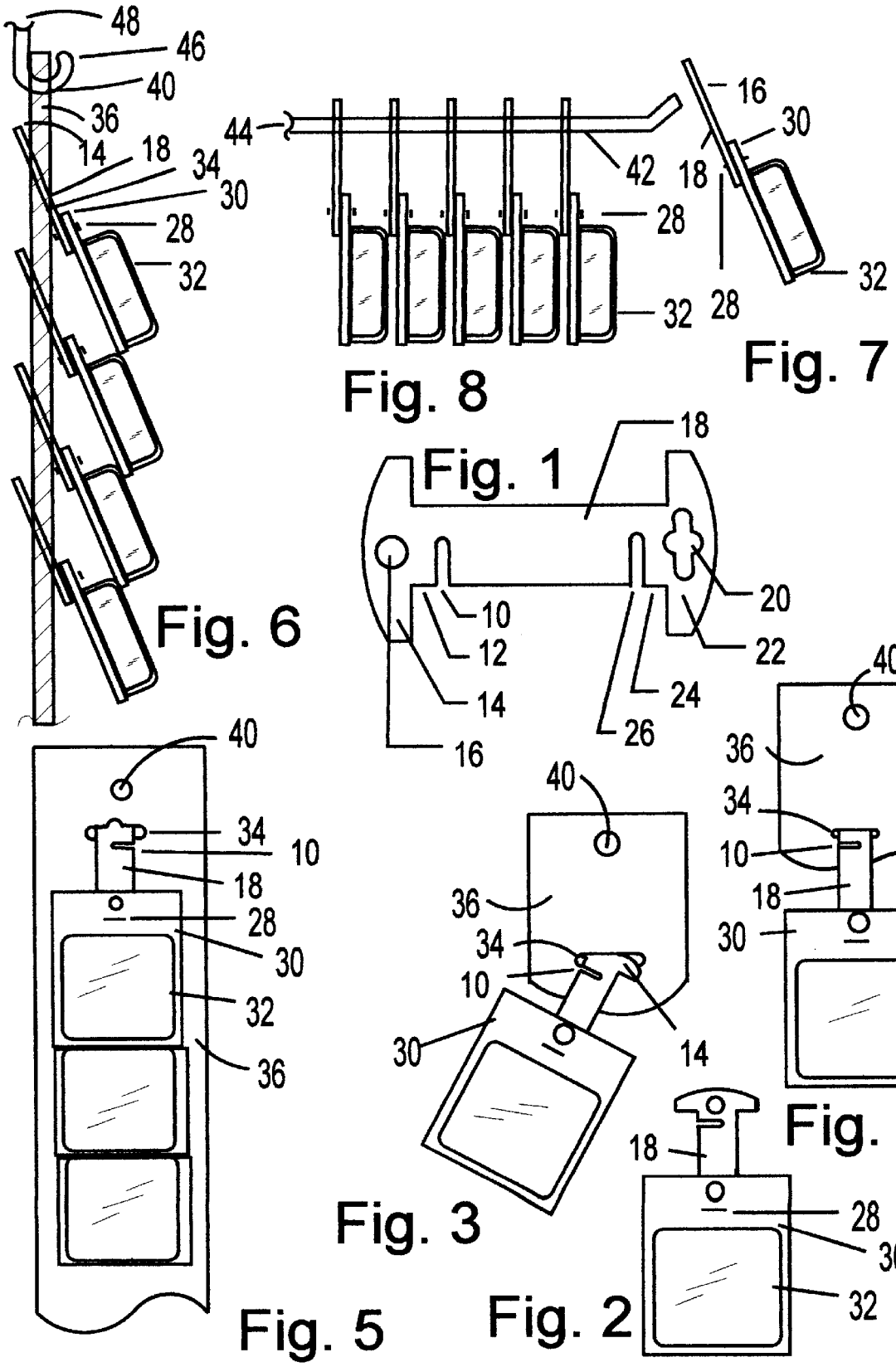
FIG. 6 Is a side view of the hang strip portion of the invention 36 with linked packages as in FIG. 4 or FIG. 5
FIG. 7 Is a side view of FIG. 2
FIG. 8 Is a side view of packaged product as in FIG. 2 suspended on a hook 42.

FIG. 12 Is a partial front view of the hang strip portion of the invention 36 with product package 30 attached to the link 18.

FIG. 13 Is a partial front view of the hang strip portion of the invention 36 with link 18 attached. Multiple product packs 30 are shown loaded on the link 18.

FIG. 14 Is a front view of an item such as; a coiled product such as; rope, tubing or wire 31. Also 31 could represent a closed ended item such as a ring or a handle. Item has been placed within the folded link body 18

FIG. 15 Is a front view of the; ring, coil or handle 31 secured in the body of the link 18 and ready to go on the hang strip 36 or on a hook as in 42

FIG. 16 Is a front view of a product package 30 with one end of link 14 being introduced into the package cut out 38

FIG. 17 Is a front view of the product package 30 with one link 18 attached showing locking notch 10

Figure 18:
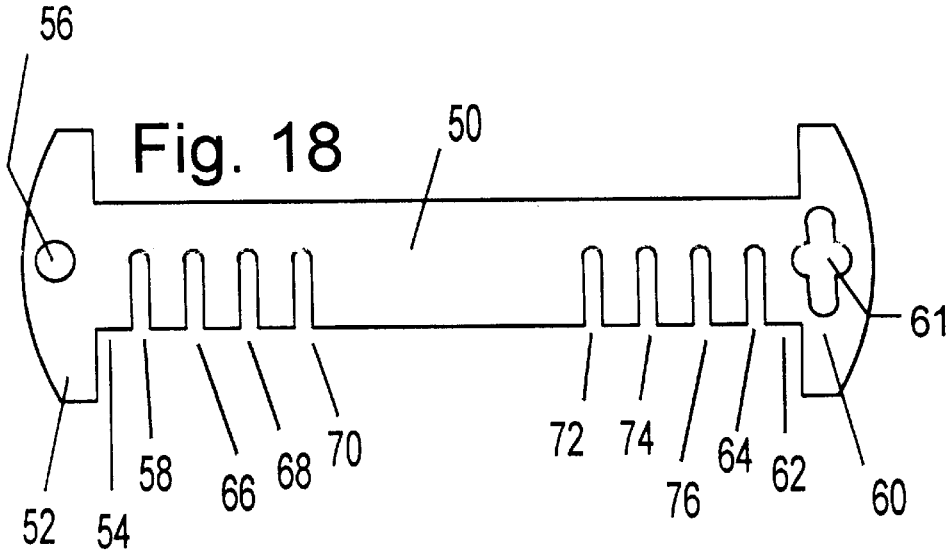

FIG. 18 Is a front view of the original invention as it appeared in Nov. 12, 1998 Provisional pat application No. 60/108,022 Adjustable, reusable box closing device+handle. 50 The link portion of the present invention FIG. 1 is a shorter version of the original invention FIG. 18 The link is also a box closer.

Figure 19:
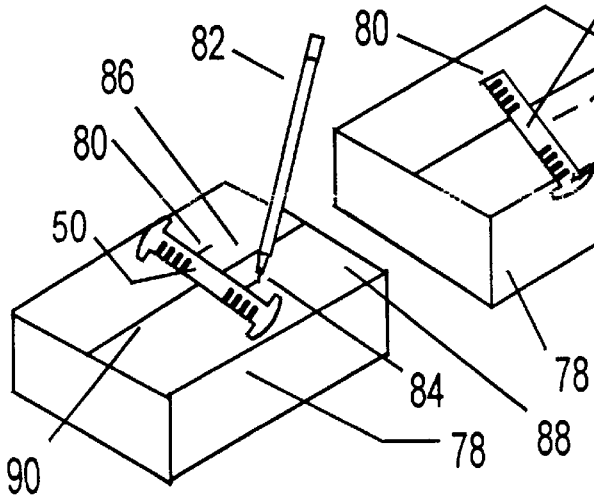

FIG. 19 Is an isometric view of a box 78 with the box closer 50 being used as a guide for cutting left slit 80 and right slit 84 in box flaps 86 and 88.

Figure 20:
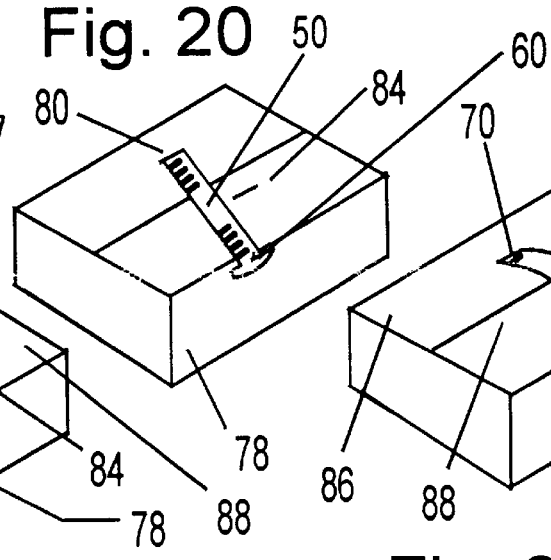

FIG. 20 Is an isometric view of a box 78 with one end of the closer 50 inserted into the cut slit 80 in the left flap 86 of the box. The opposite end of the closer 60 will be inserted into the other cut slit 84.

Figure 21:
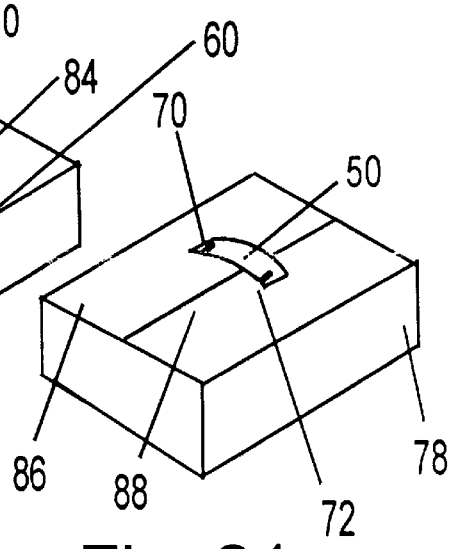

FIG. 21 Is an isometric view of a box 78 with the closer 50 locked in place by sliding cut notches 70 and 72 into place Both flaps 86 and 88 have been connected by using the box closer 50 and a small handle has been created as well.

Figure 22:
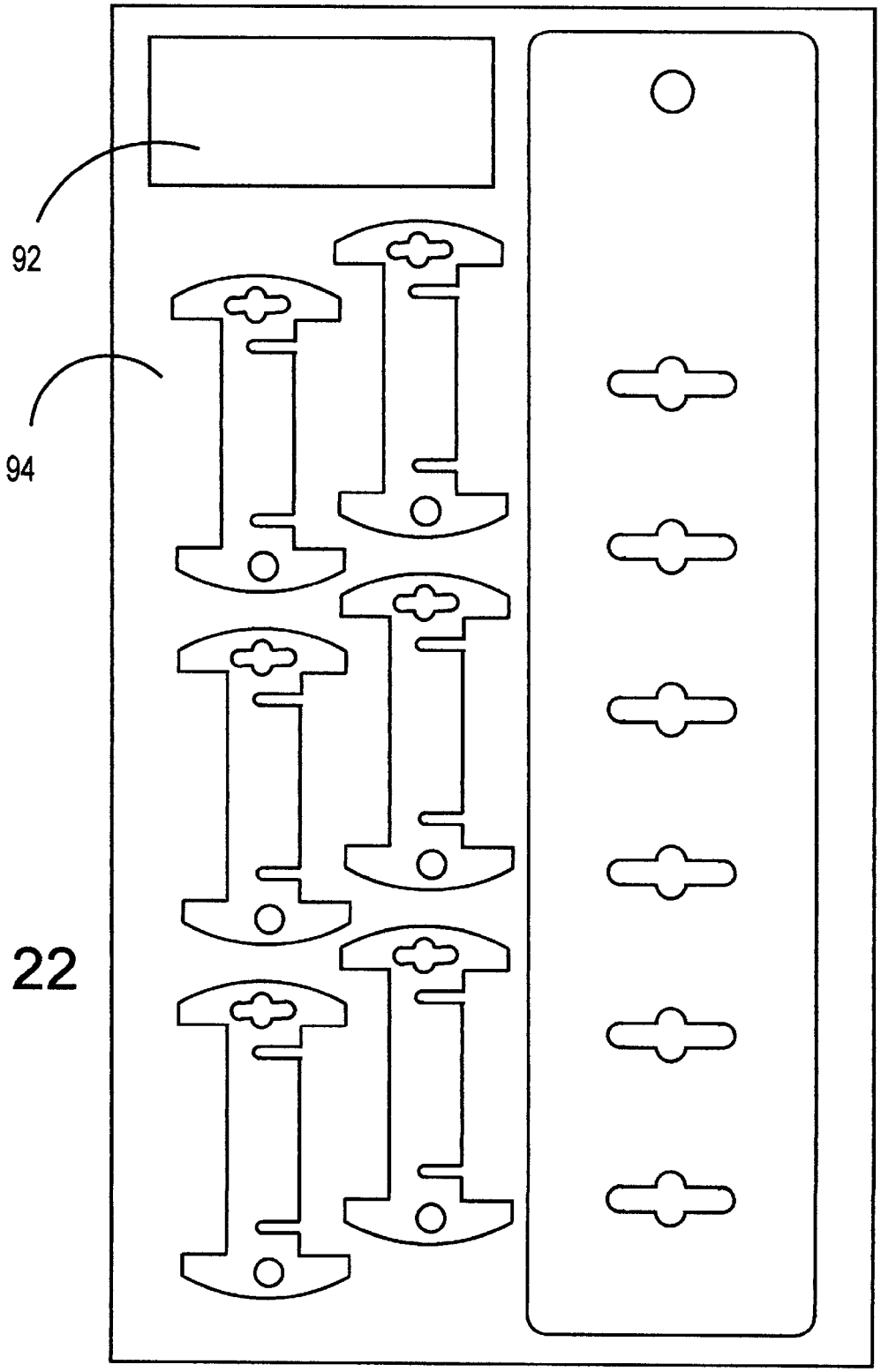

FIG. 22 Is a front view of the invention 94 showing the hanging strip with its six cut outs and six connecting links cut from a single sheet of flexible plastic material in natural or one of the 12 available colors. Multiple strip widths and weights will be made available to buyers of the invention.

DETAILED DESCRIPTIONS OF THE DRAWINGS

Figure 9:
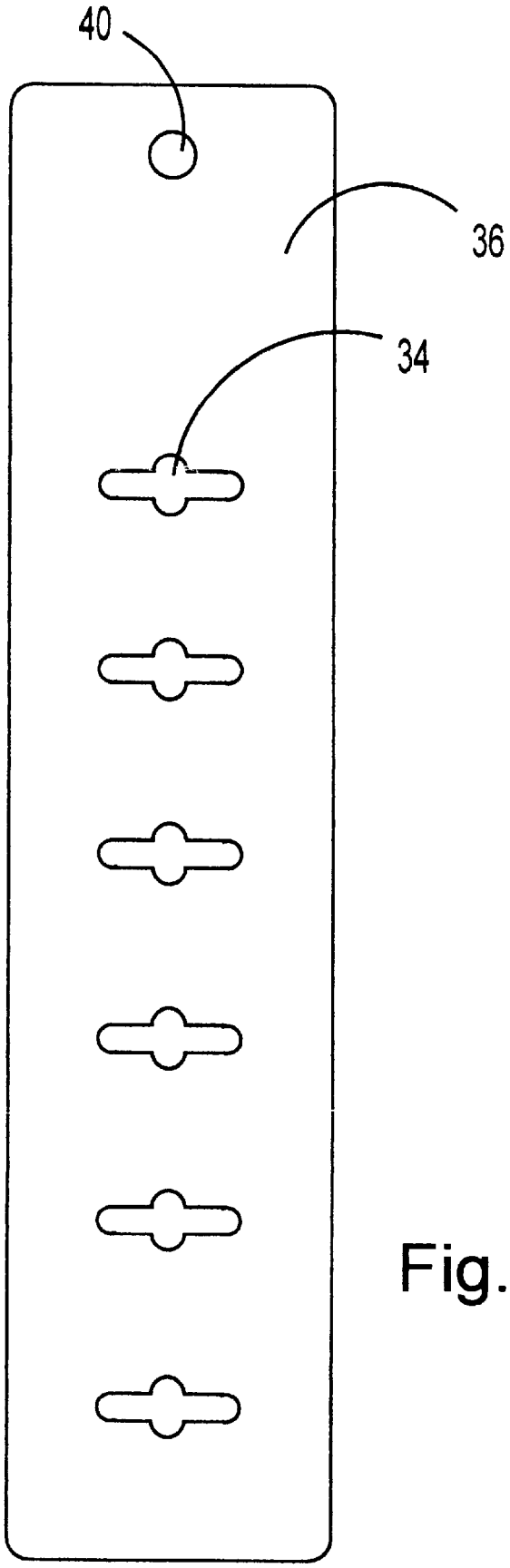
FIG. 9 Is a front view of the hang strip portion of the invention showing its three basic parts; body 36, cutouts 34, and hole to suspend it 40.

The complete invention FIG. 22 is comprised of a hanging strip FIG. 9 and the product hanging links as in FIG. 1 The link can be used in many ways to do many jobs.

Looking at FIG. 1 we see the link 18 used to connect product packages 30 to the hanging strip 36. The parts of the link as numbered are the hole side notch 10 the hole side step 12 the hole side T end 14 and the hanging hole 16 the body of the link 18 the opposite end is the cutout side notch 26 the cut out side step 26 the cutout side T end and the cutout in the T 20. Looking at FIG. 2 we see a plastic blister 32 with part below (not shown) glued to a card 30 which has been attached to the body of the link 18 by means of a staple. Looking at FIG. 3 we see how the product and link as in FIG. 2 are attached to a hanging strip 36 shown in a front partial view. The T shaped end 14 of the link step 12 and notch 10 introduced into the cutout hole 34 in the strip 36. The next view of the process FIG. 4 shows the product package and connected link as in FIG. 2 locked in place on the hanging strip 36 evidenced by the notch 10 The strip can be suspended from hole,40 using a hook see 46 or 42 The hanging strip has a number of spaced cutouts 34 to receive either end 14 or 22 of the link 18 and its attached product package 30 FIG. 5 is a front view of a partial hanging strip 36 and three packages 30 hanging on the strip. FIG. 6 is a side view of products secured to the link as in FIG. 2 attached to a hanging strip 36 and suspended from hole 40 which has been placed on hook 46 other end of hook 48 is attached to a store fixture (not shown) A side view of FIG. 2 gives us FIG. 7 This side view shows how the hole 16 in the link 18 can be used to hang product pack 30 from a hook 42 or as in FIG. 8 multiple blister packed products 32 are shown suspended from the hook 42 the opposite end 44 is attached to a board designed to receive it(not shown) The hanging strip portion of the invention is shown in FIG. 9 The body of the strip 36 with its cutouts 34 and the hole to hang it from 40. In FIG. 10 the notch 10 and the T shaped link end 14 are being introduced into the cut out 34 in the hanging strip body 36. FIG. 11 shows the notch 10 clearly visible assuring a lock has been made with cutout 34 in the strip 36. FIG. 12 shows a blister or skin packaged product 30 hanging from the link 18 which has been attached to strip 36 by using its cutout 34. The locking notch of the link 10 is visible assuring product is secure and the strip 36 is ready to be suspended from hole 40 by using a hook (not shown) FIG. 13 is very much the same as FIG. 12 in that the link 18 is secured to the cut out 34 in the hanging strip 36 with the exception that multiple products 30 have been loaded on the link. Multiple product loading will be explained as we discuss FIG. 16 and FIG. 17 and then refer back to FIG. 13. FIG. 16 shows the cutout 38 of a product package 30 with one link end 14 being engaged full entry of the T being allowed by use of the notch 10. FIG. 17 shows the blister or skin packaged product package 30 attached and locked to the link 18 using the packages cutout hole 38. The link end 22 with the cut out 20 and notch 26 can be can be loaded on a hanging strip 36 or hung from a pegboard hook (not shown) using the cutout section 20 of the link.

The link FIG. 1 can be used in a number of interesting ways and FIG. 14 and FIG. 15 are being used to show one unique example. FIG. 14 depicts a coiled product such as; tubing, wire, rope, hose or cable 31 within the folded body 18 of the link FIG. 1. 31 can also represent the handle of a product or a closed ended item like a wooden or metal ring. The item 31 is placed within the folded body 18 of the link FIG. 1 then the end of the link with hole 14 is passed through cut out 20 by using the notch 10 to allow entry. FIG. 15 is the result of the anions taken in FIG. 14 . In FIG. 15 the coiled product 31 or the closed ended product 31 is secured within the body of the link 18. the notch 10 is well above the cutout insuring product lock. At this point product 31 and link 18 can be attached to a hanging strip 36 using the upper T 14 or hung using the hole 16 from a hook as in 42 of FIG. 8.

BOX CLOSING WITH THE SHORT AND LONG LINKS

The small link and the longer link can both be used to close the flaps of a box or keep the flaps open for loading. FIG. 1 the small or short link and FIG. 18 the long link or box closer link have the same end configurations and the same step and notch locations. The chief difference being the added length of the box closer link and the six additional notches added along this length. We look at FIG. 18 and see this is true the T shaped end 52 with the hole 56 the step 54 and the notch 58 are of the same configuration as the parts of the small link FIG. 1. The same holds true on the opposite end of the box closer link T shape 60 the cut out inside 61 the step 62 and the notch 64 . FIG. 1 the small link ends and FIG. 18 the long link ends are secured in cut outs or cut slits as in FIG. 19 see 80 and 84 using the same T and notch locking method. In FIG. 18 the added notch sets 66 and 76, 68 and 74, and 70 and 72 are used to filly close the box flaps as will be shown in FIG. 21 where notches 70 and 72 have been selected. The body 50 of the box closer link FIG. 18 can also be used as a box handle for light loads as is seen in FIG. 21.

FIGS. 19, 20, 21 are a sequence of events showing how the box close link is utilized. In FIG. 19 a carton 78 whose bottom flaps have been sealed is ready to have the top flaps 86 left and 88 right temporarily closed they are shown in a flat position. The box closer link FIG. 18 has been placed over both flaps with the body 50 centered over the line of their closure 90. A slit 80 is cut that is the width of the body 50 of the box closer link in left flap 86 using a knife as in 82 . A slit 84 is cut in the right flap 88 the same length as 80. Slits are placed using any of the six notch sets 66 and 76, 68 and 74, or 70 and 72. The closer the slits 80 and 84 the longer the box closer link handle will be. FIG. 20 shows box closer FIG. 18 with T end 52 inserted in left flap slit 80 next step is to take the opposite end 60 and insert that into the right slit 84 of the box 78. FIG. 21 shows left flap 86 and right flap 88 of the box 78 closed. The locking notch set of 70 and 72 will be pushed into the slits to act as a lock.

FIG. 22 shows the invention 94 with printed instruction area 92.

DETAILED DESCRIPTION OF THE PREFERRED EMBODIMENT

A preferred embodiment of the present invention is illustrated in FIG. 22 (top view). Present invention consisting of a product hanging strip FIG. 9 (top view) and connecting links FIG. 1 (top view). In the preferred embodiment the material sheet 94. (FIG. 22) used is of a flexible plastic, such as high density polyethelene available from the Formflex Company in Bloomingdale, Indiana. However the base sheet can consist of polypropylene,pvc,polycarbonate,polyester, vulcanized fiber,thin sheets of wood, or a ferrous or non ferrous metal. In the preferred embodiment FIG. 22 the high density polythelene was chosen because it is easy to cut, very strong, and comes in many different thicknesses and in over 12 different colors. The thickness of the preferred embodiment would be 0.41 mm, 0.58 mm, or 0.76 mm. Optional materials thicknesses will vary in accordance to standard sheet production weights for them.

FIG. 1 the link portion of the invention has a preferred length of 92 mm. However the link FIG. 1 can be produced in any length needed to do the job required of it. The link FIG. 1 has a T shape at each of its ends that measures 50.8 mm×6.35 mm with an arched top of approximately 38.2 mm. See 14. of (FIG. 1). The comers of the T shaped ends are rounded for safety and aid in inventions use. The step 12. Of (FIG. 1) measures 25.4 mm wide and steps over approx 6.35 mm where it meets up with notch 10. of (FIG. 1). The notch is 12.7 mm long and its preferred width is 3.18 mm do note this will vary by as much as 0.50 mm plus or minus, according to job requirements. The notch will have a full radius that matches its width. The body of the link or hand hold section 18 of link (FIG. 1) is 25.4 mm wide and the preferred length including both steps 12. And 24 of (FIG. 1) is 63.5 mm. Length between the notches 10. And 26 of (FIG. 1) is 42.86 mm. The length of the body 18 can be produced at whatever length is needed, notches can be added as well. The T shape 14 of link (FIG. 1) has a hole 6.35 mm in diameter and spaced center and down at about 6.35 nm. The T 22. (FIG. 1) on the opposite side has a blister pack style cutout 20 (FIG. 1) preferred dimensions approximately 31.75 mm long×4.76 wide centered on the head of the T 22. (FIG. 1).

The hanging strip FIG. 9 is the partner to the link FIG. 1. The body 36 of (FIG. 9) is 35 to 45 mm wide. However the width of strip will vary according to the package size of the product being displayed on it. The preferred length of the strip is 330 to 381 mm. cutouts 34 of (FIG. 9) equal in size to the cut out 20 in (FIG. 1) are spaced down the body 36 of the strip (FIG. 9), these will accept the head 14 and notch 10 of link (FIG. 1). The strip (FIG. 9) is suspended from a hook (not shown in FIG. 9) from a 6.35 mm hole 40. cut 6.35 mm down from top center of the strip body 36 (FIG. 9).

FIG. 18—Additional Embodiments

Additional embodiments are shown in FIG. 18 where the Link as in (FIG. 1) has a longer body 50 of (FIG. 18) and additional notch sets 66,76,68,74, and 70 and 72 of (FIG. 18). FIG. 18 is the box closer with handle version of the invention it is constructed from the same flexible plastics as the link in (FIG. 1).

What is claimed is:

1. A point-of-purchase product access strip with removable straps having T shaped ends for hanging various items comprising:

a) a strip comprising an elongated uniformly flat flexible plastic strip of uniform width with a through hole top center for vertical hanging, said strip having at least two through cut slots, each slot sufficiently spaced along the length of the strip, the placement of each slot in the strip being longitudinal, each said slot being of sufficient width and length to receive a T shaped end of a strap, b) at least one flexible plastic strap, said at least one strap being of uniform thickness having a body of sufficient length and uniform width, each strap end having a block letter T shape having a head and a body, the head of said T shape having an arched top with the head length being twice the width of the body of the strap with each T body integral with the other, one T shaped end being upright and the other T shaped end being inverted with the bodies of the two T shaped ends joined at the center of the strap, each said T shaped end of the strap having a through cut notch in the body of the T, adjacent to the area where the head and body of the T are joined, said notch acting as a key allowing the T shaped end of the strap entry into a slot.

2. A point-of-purchase product access strip according to claim 1, wherein said strip has an elongated rectangular shape with all corners radiused.

3. A point-of-purchase product access strip according to claim 1, wherein at least one of the T shaped ends of the plastic strap has a slot in the head thereof.

4. A method of connection between a T shaped member and a slot, said T shaped member having a head and a body with a notch, comprising the steps of:

a) feeding the head of the T shaped member into the slot by using the notch on the body of the T shaped member as a key, said head of said T shaped member dropping into place and engaging said slot when said notch exits said slot; whereby, b) the head of the T shaped member being held securely in said slot until reversal of the process is used to remove the T shaped member from its position in the slot.

5. A method of securing a product in a strap comprising the steps of:

a) providing A T shaped strap of sufficient length, said T shaped strap having a body, a head at one end of said body, a through cut slot at the other end of said body, for receiving the head of said strap, and a notch on said body between said head and said slot;

b) placing said product in said body of said strap and suspending said product in a loop in the strap created when both ends of the strap are lifted;

c) feeding the head end of the T shaped strap through the through cut slot in the other end of said strap by using the notch on the body as a key;

d) freeing the notch from the slot, whereby said notch travels upward away from the slot as the other end of the strap is lifted, allowing the loop in the strap to close around the product, whereby said product will be held securely within the closed loop until a reversal of the process is used to release said product.

6. A method of connecting a first planar member having a T shaped section with a head, and body with a notch, to a second planar member having a through cut slot, in such a manner that the connection will show evidence of a secure connection of the first and second planar members, comprising the steps of:

a) feeding said T shaped section of said first planar member through said through cut slot in said second planar member using said notch in the body of said first planar member as a key;

b) releasing said notch from slot, whereby said notch exits down out of said slot allowing the head of the T shaped section of said first planar member to seat into place, said notch being fully visible below said slot; whereby, c) said first and second planar members are connected, with the notch fully visible as evidence of the connection.

7. A method of closing the flaps of a carton and providing a handle for said carton by using a flexible plastic strap, said strap having a body with a set of strap notches in said body, and said strap having a T shape at each end, said method comprising the steps of:

a) taping closed the bottom flaps of said carton;

b) folding the top flaps of said carton to be closed, and cutting a one inch slit into each of the top flaps using the set of strap notches as a guide;

c) inserting a T shaped end of said strap into one of said slits using a notch in the strap body as a key;

d) inserting the other T shaped end of said strap into the other of said slits using a notch in the strap body as a key;

e) releasing said notches from said slits inwardly, allowing heads of both T shaped ends of said strap to seat in the slits of the carton flaps when the body of the strap is lifted; whereby, f) each end of the strap is secured in a carton flap, said strap bridging the center section of the carton between the flaps, thus closing the carton and providing a handle.

* * * * *